US008787123B2

(12) United States Patent
Takenawa

(10) Patent No.: US 8,787,123 B2
(45) Date of Patent: Jul. 22, 2014

(54) INFORMATION NOTIFYING DEVICE AND ELECTRONIC TIMEPIECE

(71) Applicant: Casio Computer Co., Ltd., Tokyo (JP)

(72) Inventor: Hideo Takenawa, Hachioji (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 13/831,423

(22) Filed: Mar. 14, 2013

(65) Prior Publication Data

US 2013/0250735 A1 Sep. 26, 2013

(30) Foreign Application Priority Data

Mar. 21, 2012 (JP) ..... 2012-063574

(51) Int. Cl.
*G04C 5/00* (2006.01)
*G04C 99/00* (2006.01)

(52) U.S. Cl.
USPC ..... 368/233; 368/250

(58) Field of Classification Search
USPC ..... 368/10, 223, 243, 250–255, 232–233
See application file for complete search history.

(56) References Cited

U.S. PATENT DOCUMENTS 5,181,190 A * 1/1993 Kanzaki ..... 368/76
5,202,858 A * 4/1993 Kanzaki ..... 368/71
5,222,053 A * 6/1993 Ohhira ..... 368/73
5,805,535 A * 9/1998 Guyard et al. ..... 368/283
5,878,004 A * 3/1999 Miyauchi et al. ..... 368/230
6,349,075 B1 * 2/2002 Miyauchi et al. ..... 368/230
7,266,047 B2 * 9/2007 Chan ..... 368/10
7,350,969 B2 * 4/2008 Maire ..... 368/295
7,420,885 B2 * 9/2008 Claret et al. ..... 368/265

FOREIGN PATENT DOCUMENTS

JP 04-175688 A 6/1992
JP 08-065745 A 3/1996
JP 2001-012966 1/2001
JP 2007-281786 A 10/2007
JP 2011-050023 A 3/2011

OTHER PUBLICATIONS

Japanese Office Action dated Dec. 10, 2013 (and English translation thereof) in counterpart Japanese Application No. 2012-063574.

* cited by examiner

*Primary Examiner* — Sean Kayes
(74) *Attorney, Agent, or Firm* — Holtz Holtz Goodman & Chick PC

(57) ABSTRACT

The present invention provides an information notifying device including an hour plate with a display opening, a vibrating motor which is placed on a lower side of the hour plate and causes vibration with eccentric rotation of an eccentric rotation section for information notification, and a rotary plate which rotates with the eccentric rotation of the eccentric rotation section of the vibrating motor and exposes a function display section from the display opening for information notification.

20 Claims, 15 Drawing Sheets

INFORMATION NOTIFYING DEVICE AND ELECTRONIC TIMEPIECE

CROSS-REFERENCE TO RELATED APPLICATION

This application is based upon and claims the benefit of priority from the prior Japanese Patent Application No. 2012-063574, filed Mar. 21, 2012, the entire contents of which is incorporated herein by reference.

BACKGROUND OF THE INVENTION

1. Field of the Invention

The present invention relates to an information notifying device for use in a portable device such as an electronic watch, and an electronic timepiece including the information notifying device.

2. Description of the Related Art

For example, as disclosed in Japanese Patent Application Laid-Open (Kokai) Publication No. Heisei 08-065745, an electronic watch has been known that is configured to include a communication function for communication with a portable phone and cause a vibrator to vibrate when receiving a calling signal from the portable phone to let the user of the electronic watch to know that a calling has come.

However, this electronic watch merely causes the vibrator to vibrate when receiving a calling signal from the portable phone and notifying the user that a calling has come. Therefore, details of calling from the portable phone cannot be known.

The present invention is to provide an information notifying device and electronic timepiece capable of notifying a user of information by vibration and also notifying notification details visually.

SUMMARY OF THE INVENTION

In accordance with one aspect of the present invention, there is provided an information notifying device comprising: an hour plate with a display opening; a vibrating motor which is placed on a lower side of the hour plate and causes vibration with eccentric rotation of an eccentric rotation section for information notification; and a rotary plate which rotates with the eccentric rotation of the eccentric rotation section of the vibrating motor and exposes a function display section from the display opening for information notification.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS (First Embodiment)

With reference to FIG. 1 to FIG. 11, a first embodiment in which the present invention is applied to an electronic watch is described below.

Figure 1:
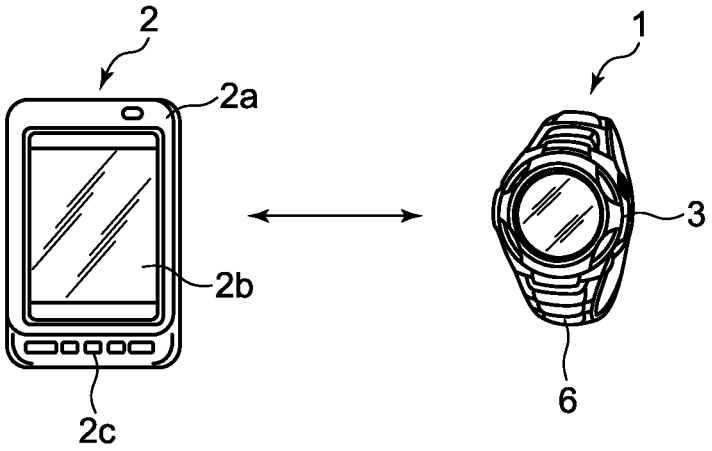
FIG. 1 is a diagram of a first embodiment in which the present invention is applied to an electronic watch.

As depicted in FIG. 1, an electronic watch 1 has a short-range wireless function, and is configured to perform short-range wireless communication with a portable information terminal 2. The portable information terminal 2 is configured to perform short-range communication with the electronic watch 1 and also perform long-range wireless communication with a base station.

Figure 2:
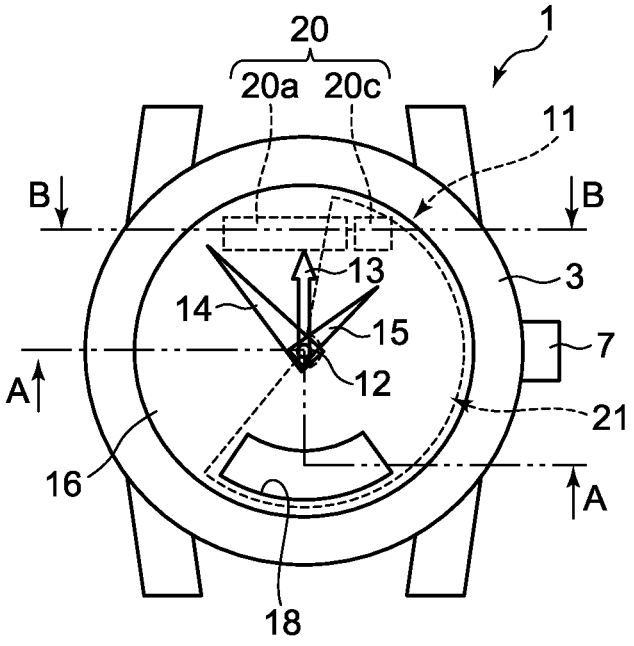
FIG. 2 is an enlarged front view of the state in which a display opening is closed with a rotary plate in the electronic watch depicted in FIG. 1.
Figure 3:
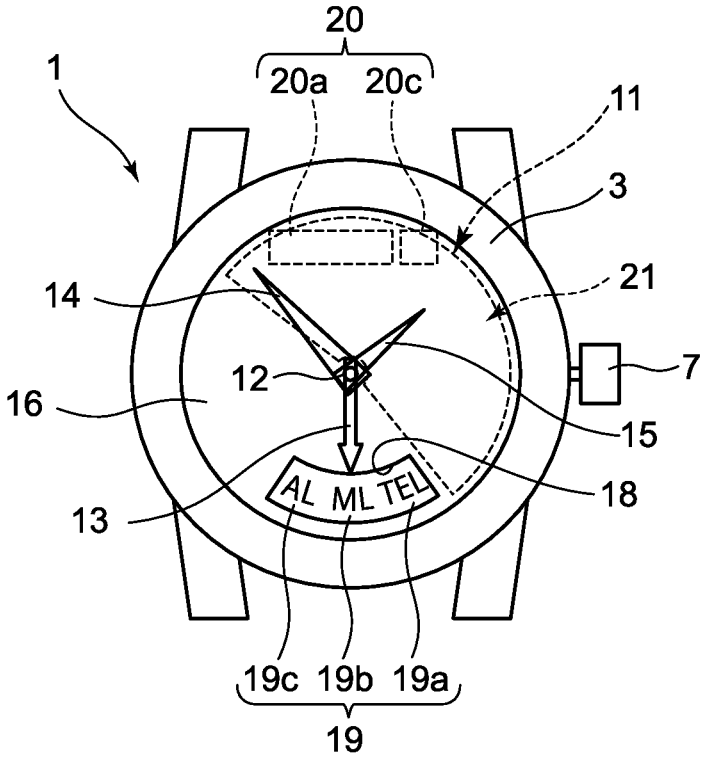
FIG. 3 is an enlarged front view of the state in which a function display section is exposed with the display opening open in the electronic watch depicted in FIG. 2.

As depicted in FIG. 1 to FIG. 5, the electronic watch 1 includes a watch case 3. On an upper opening of the watch case 3, a watch glass 4 is mounted. On a lower part of the watch case 3, a rear lid 5 is mounted. Furthermore, as depicted in FIG. 1, a watch band 6 is mounted on each of twelve o'clock and six o'clock sides of the watch case 3 and, as depicted in FIG. 2 and FIG. 3, a crown 7 with a switch function for time correction is mounted on a three o'clock side of the watch case 3.

Figure 4:
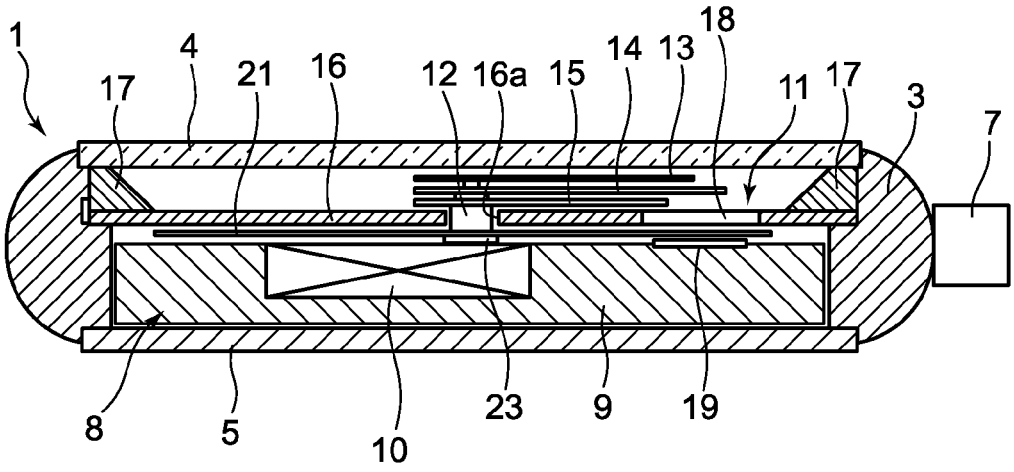
FIG. 4 is an enlarged sectional view of the electronic watch taken along line A-A in FIG. 2.
Figure 5:
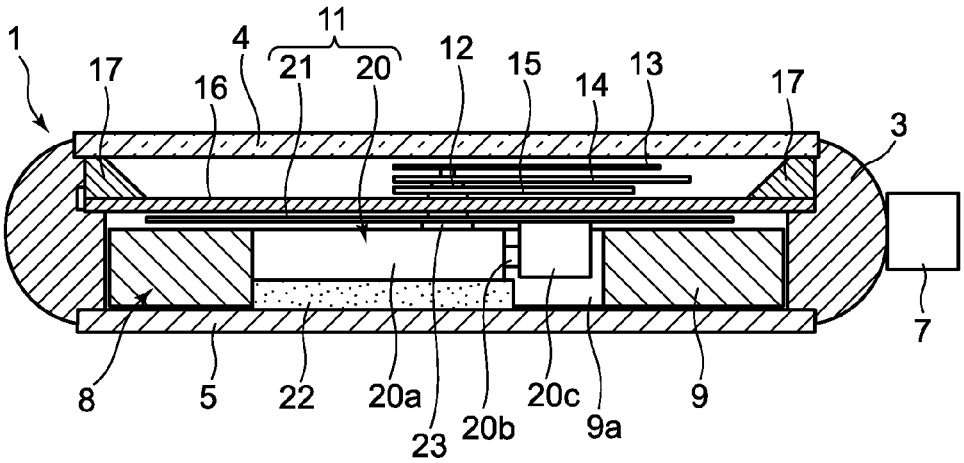
FIG. 5 is an enlarged sectional view of the electronic watch taken along line B-B in FIG. 2.

Inside the watch case 3, a watch module 8 is placed as depicted in FIG. 4 and FIG. 5. The watch module 8 includes a housing 9. The housing 9 is provided with a clock movement 10 and an information notifying device 11, as well as various electronic components (not depicted in the drawings) necessary for a watch function and a short-range communication function.

The clock movement 10 is configured to rotate a pointer shaft 12 to move a second hand 13 (a pointer), a minute hand 14 (a pointer), and an hour hand 15 (a pointer) as depicted in FIG. 4. In this case, the clock movement 10 includes a first driving system for operating the second hand 13 alone and a second driving system for operating the minute hand 14 and the hour hand 15.

As depicted in FIG. 4 and FIG. 5, an hour plate 16 is placed above the housing 9 so as to be spaced a predetermined distance apart from an upper surface of the housing 9. On a perimeter of the hour plate 16, a ring-shaped parting member 17 is placed as being interposed between the watch glass 4 and the hour plate 16. The hour plate 16 is provided with a through hole 16*a* for letting the pointer shaft 12 protrude upward from below.

With this, the second hand 13, the minute hand 14, and the hour hand 15 are configured to be mounted on an upper part of the pointer shaft 12 to be moved above the hour plate 16 as depicted in FIG. 4 and FIG. 5, thereby indicating time as depicted in FIG. 2. As depicted in FIG. 2 and FIG. 3, a display opening 18 is provided to the hour plate 16 so as to correspond to five o'clock to seven o'clock. The display opening 18 is formed in the form of an arc-shaped long hole centering at the pointer shaft 12. As depicted in FIG. 3 and FIG. 4, a function display section 19, which will be described further below, is provided on the upper surface of the housing 9 positioned below the display opening 18 so as to correspond to the display opening 18.

On the other hand, as depicted in FIG. 2 to FIG. 5, the information notifying device 11 includes a vibrating motor 20 for causing vibration for notification of information and a rotary plate 21 to be rotated by the vibrating motor 20 for opening and closing the display opening 18 of the hour plate 16. The vibrating motor 20 includes a motor main body 20*a* and an eccentric rotation section 20*c* mounted as being eccentric to an output shaft 20*b* of the motor main body 20*a*.

The motor main body 20*a* of the vibrating motor 20 is placed inside the housing 9 at a position on a twelve o'clock side via a cushioning material 22 such as rubber or elastomer, as depicted in FIG. 2, FIG. 3 and FIG. 5. The eccentric rotation section 20*c* is configured to be placed inside a space section 9*a* of the housing 9 and, in this state, be exposed as being able to appear above the housing 9. With this, the vibrating motor 20 is configured such that, with the motor main body 20*a* being driven and rotated, the eccentric rotation section 20*c* makes an eccentric rotation about the output shaft 20*b*, thereby causing vibration.

As depicted in FIG. 2 and FIG. 3, the rotary plate 21 is formed in an approximately semi-circular shape, and has an intermediate section of the arc of the semicircle rotatably mounted on a bearing section 23 provided to the housing 9. In this case, the pointer shaft 12 is rotatably mounted at the center of the bearing section 23. As depicted in FIG. 5 and FIG. 6, the rotary plate 21 is configured such that the eccentric rotation section 20*c* of the vibrating motor 20 detachably makes contact with a lower surface of the rotary plate 21, thereby causing the rotary plate 21 to rotate about the pointer shaft 12 with the rotation of the eccentric rotation section 20*c*.

Figure 6A:
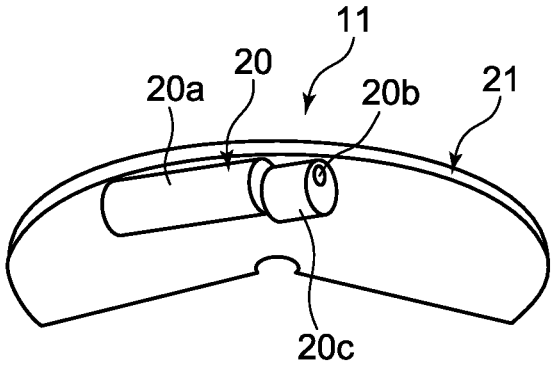
FIG. 6A is an enlarged perspective view of a correspondence between a vibrating motor and the rotary plate in an information notifying device of the electronic watch depicted in FIG. 3 when viewed from a lower surface side.
Figure 6B:
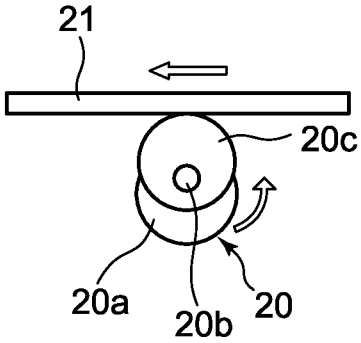
FIG. 6B is an enlarged side view of the correspondence between the vibrating motor and the rotary plate in the information notifying device of the electronic watch depicted in FIG. 3.

That is, as depicted in FIG. 6A and FIG. 6B, when the eccentric rotation section 20*c* eccentrically rotates about the output shaft 20*b*, an outer peripheral surface of the eccentric rotation section 20*c* farthest away from the output shaft 20*b* makes contact with the rotary plate 21, and this contact provides a rotating force. The rotary plate 21 is configured to intermittently rotate with the repetition of this contact and non-contact. In this case, as depicted in FIG. 2 and FIG. 3, the rotary plate 21 is configured to rotate about the pointer shaft 12 at a predetermined angle, for example, approximately 60 degrees to approximately 90 degrees, to open and close the display opening 18 of the hour plate 16.

With this, the rotary plate 21 is configured to be normally located at an initial position for closing the display opening 18 of the hour plate 16 as depicted in FIG. 2 and then rotate about the pointer shaft 12 at the predetermined angle when the vibrating motor 20 rotates, thereby opening the display opening 18 of the hour plate 16 as depicted in FIG. 3. It is desirable to provide a friction sheet (not shown in the drawings) with a large friction resistance such as a rubber sheet on the lower surface of the rotary plate 21 and the outer peripheral surface of the eccentric rotation section 20*c*.

Figure 7:
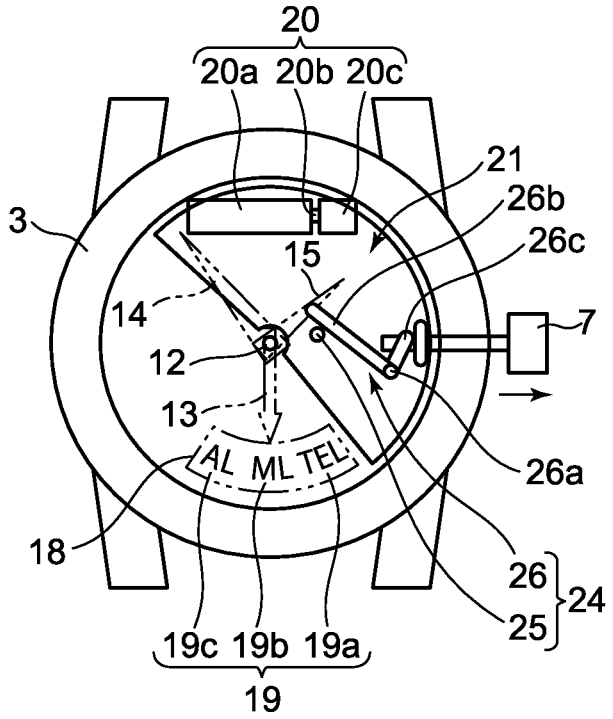
FIG. 7 is a diagram of the state in which a crown is pushed out by a return device in the information notifying device of the electronic watch depicted in FIG. 3.
Figure 8:
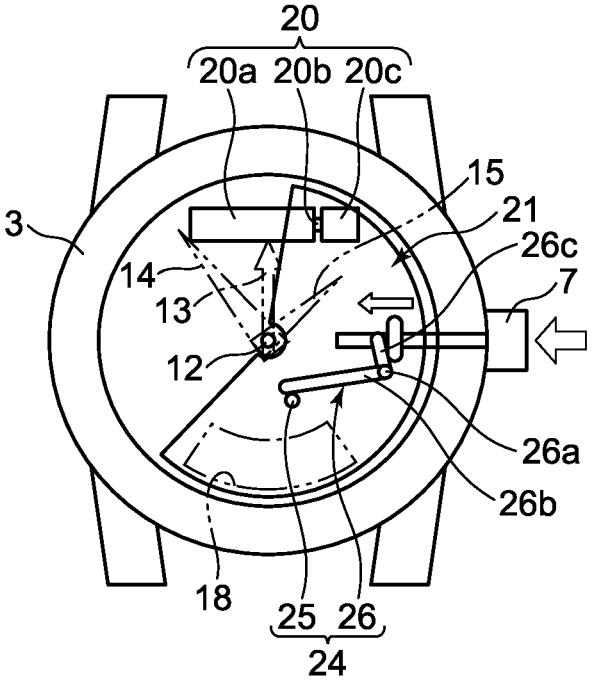
FIG. 8 is a diagram of the state in which the crown is pushed in and the return device rotates the rotary plate to an original position.

Furthermore, in the state where the display opening 18 of the hour plate 16 is open as depicted in FIG. 7, the rotary plate 21 is configured to be returned by a return member 24 to the initial position for closing the display opening 18 of the hour plate 16 as depicted in FIG. 8. This return member 24 includes an interlocked pin 25 provided to the rotary plate 21 and a link section 26 that moves the crown 7 in an appearing direction in conjunction with the interlocked pin 25.

As depicted in FIG. 7 and FIG. 8, the interlocked pin 25 is configured to be provided at a position slightly away from the rotation center of the rotary plate 21 to move and rotate together with the rotary plate 21. The link section 26 is configured to be bent in a substantially L shape, and a fulcrum 26*a* is provided at the corner of this bent shape. In this state, one end 26*b* of the link section 26 rotates about the fulcrum 26*a* together with the interlocked pin 25, and another end 26*c* of the link section 26 rotates about the fulcrum 26*a* together with the crown 7.

With this, the return member 24 is configured so that, when the rotary plate 21 is rotated by the vibrating motor 20 in a counterclockwise direction to open the display opening 18 of the hour plate 16, the one end 26*b* of the link section 26 is pushed by the interlocked pin 25, thereby causing the link section 26 to rotate about the fulcrum 26*a* in a clockwise direction and causing the other end 26*c* of the link section 26 to push out the crown 7 accordingly, as depicted in FIG. 7.

Furthermore, the return member 24 is configured so that, when the crown 7 is pushed in to close the display opening 18 of the hour plate 16 with the rotary plate 21, the other end 26*c* of the link section 26 is pushed by the crown 7 to cause the link section 26 to rotate about the fulcrum 26*a* in a counterclockwise direction and accordingly cause the one end 26*b* of the link section 26 to push the interlocked pin 25, thereby causing the rotary plate 21 to rotate in a clockwise direction to close the display opening 18 of the hour plate 16, as depicted in FIG. 8.

Meanwhile, as depicted in FIG. 3 and FIG. 7, a plurality of function displays 19*a* to 19*c* are displayed on the function display section 19 corresponding to the display opening 18 of the hour plate 16. Among the plurality of these function displays 19*a* to 19*c*, a first function display 19*a* displays TEL representing an incoming call at the portable information terminal 2, which will be described further below. A second function display 19*b* displays ML representing an incoming mail at the portable information terminal 2. A third function display 19*c* displays AL representing alarm time at the portable information terminal 2.

In this case, as depicted in FIG. 2 and FIG. 8, the second hand 13 is configured to normally move with the minute hand 14 and the hour hand 15 when the display opening 18 of the hour plate 16 is closed with the rotary plate 21. Then, as depicted in FIG. 3 and FIG. 7, when the rotary plate 21 rotates to open the display opening 18 of the hour plate 16, the second hand 13 is moved alone by the clock movement 10 to indicate any one of the plurality of these function displays 19*a* to 19*c* of the function display section 19 exposed from the display opening 18 of the hour plate 16.

That is, the second hand 13 is configured to indicate TEL of the first function display 19*a* of the function display section 19 when the electronic watch 1 receives data transmitted at the time of reception of an incoming call at the portable information terminal 2, indicate ML of the second function display 19*b* of the function display section 19 when the electronic watch 1 receives data transmitted at the time of reception of an incoming mail at the portable information terminal 2 and, furthermore, indicate AL of the third function display 19*c* of the function display section 19 when the electronic watch 1 receives data transmitted when the alarm time comes at the portable information terminal 2.

Figure 9:
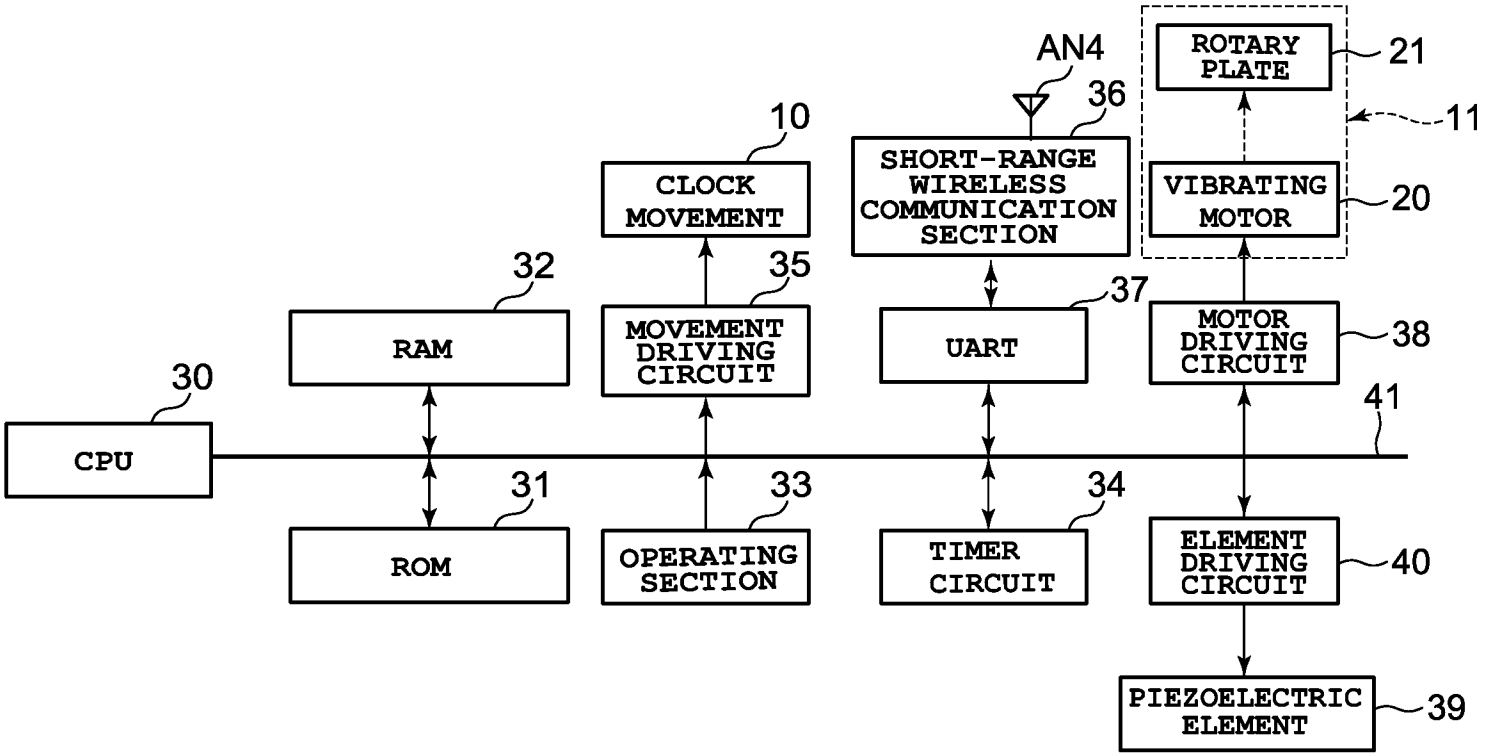
FIG. 9 is a block diagram of a circuit structure of the electronic watch depicted in FIG. 1.

Next, the circuit structure of the electronic watch 1 is described with reference to a block diagram depicted in FIG. 9.

The electronic watch includes, for example, a CPU (Central Processing Unit) 30, a ROM (Read Only Memory) 31, a RAM (Random Access Memory) 32, an operating section 33, a timer circuit 34, the clock movement 10, a movement driving circuit 35, a short-range wireless communication section 36 (a communication section), a UART (Universal Asynchronous Receiver Transmitter) 37, the vibrating motor 20, a motor driving circuit 38, a piezoelectric element 39, an element driving circuit 40, and a bus 41 for exchanging a signal between the CPU 30 and each section.

The CPU 30 performs the overall control of the entire operation of the electronic watch 1 and various arithmetic processing. The CPU 30 causes the clock movement 10 to be driven based on the current time timed by the timer circuit 34 to move the second hand 13, the minute hand 14, and the hour hand 15 to indicate the current time. Also, when receiving transmission data via the short-range wireless communication section 36 based on information obtained at the portable information terminal 2, the CPU 30 causes the vibrating motor 20 of the information notifying device 11 to be driven to cause vibration.

The ROM 31 stores various programs to be executed by the CPU 30 and initial setting data to be used by these programs. The RAM 32 provides a working memory space to the CPU 30. In the RAM 32, an execution program read from the ROM 31 is developed and temporary data is stored. The operating section 33 includes one or plurality of operation keys including the crown 7, and makes a conversion to an input signal based on a key operation by a user for output to the CPU 30.

The timer circuit 34 is a counter timing and retaining the current time. Based on current time data outputted from the timer circuit 34, the clock movement 10 is driven to move the second hand 13, the minute hand 14, and the hour hand 15 to indicate the current time. Also, the current time data and set time data regarding various function (for example, an alarm set time) are compared with each other for various operations.

In the clock movement 10, a driving signal is provided to a step motor in each of the first and second driving systems when the movement driving circuit 35 is operated by a control signal sent from the CPU 30, thereby causing each step motor to rotate to rotate the pointer shaft 12. With this, the second hand 13, the minute hand 14, and the hour hand 15 move above the hour plate 16 to indicate the current time. Alternatively, the first driving system is driven to move only the second hand 13 alone to indicate any one of the first to third function displays 19*a* to 19*c* of the function display section 19 with the second hand 13.

The short-range wireless communication section 36 is a communication control section for Bluetooth (registered trademark) communication with the portable information terminal 2, which is an external device, via an antenna AN4. The short-range wireless communication section 36 supports communication in low power consumption mode of the Bluetooth Core Specification Version 4.0, and can transmit and receive data according to a time profile.

Transmission data outputted from the CPU 30 is subjected to processing such as serial-parallel conversion at the UART 37 and is then transmitted from the short-range wireless communication section 36 to the portable information terminal 2. Reception data received by using the short-range wireless communication section 36 from the portable information terminal 2 is subjected to processing such as serial-parallel conversion at the UART 37 and is then inputted to the CPU 30.

The vibrating motor 20 provides vibration to notify the user and rotate the rotary plate 21 to expose the function display section 19. When a control signal is sent from the CPU 30 to the motor driving circuit 38, the motor driving circuit 38 makes a conversion to a voltage signal necessary for operating the vibrating motor 20 and outputs the voltage signal. The piezoelectric element 39 issues a buzzer for notifying the user. When a control signal is sent from the CPU 30 to the element driving circuit 40, the element driving circuit 40 makes a conversion to a voltage signal necessary for operating the piezoelectric element 39 and outputs the voltage signal.

Next, the portable information terminal 2 communicating with the electronic watch 1 is described with reference to FIG. 1.

The portable information terminal 2 is a multi-functional portable phone having various applications mounted thereon, and is configured to be provided with an input display section 2*b* and a plurality of operation keys 2*c* on a device case 2*a* as depicted in FIG. 1. In this case, the input display section 2*b* is configured to have a flat-type display panel placed under a transparent touch panel so that information displayed on the display panel can be viewed through the touch panel.

Figure 10:
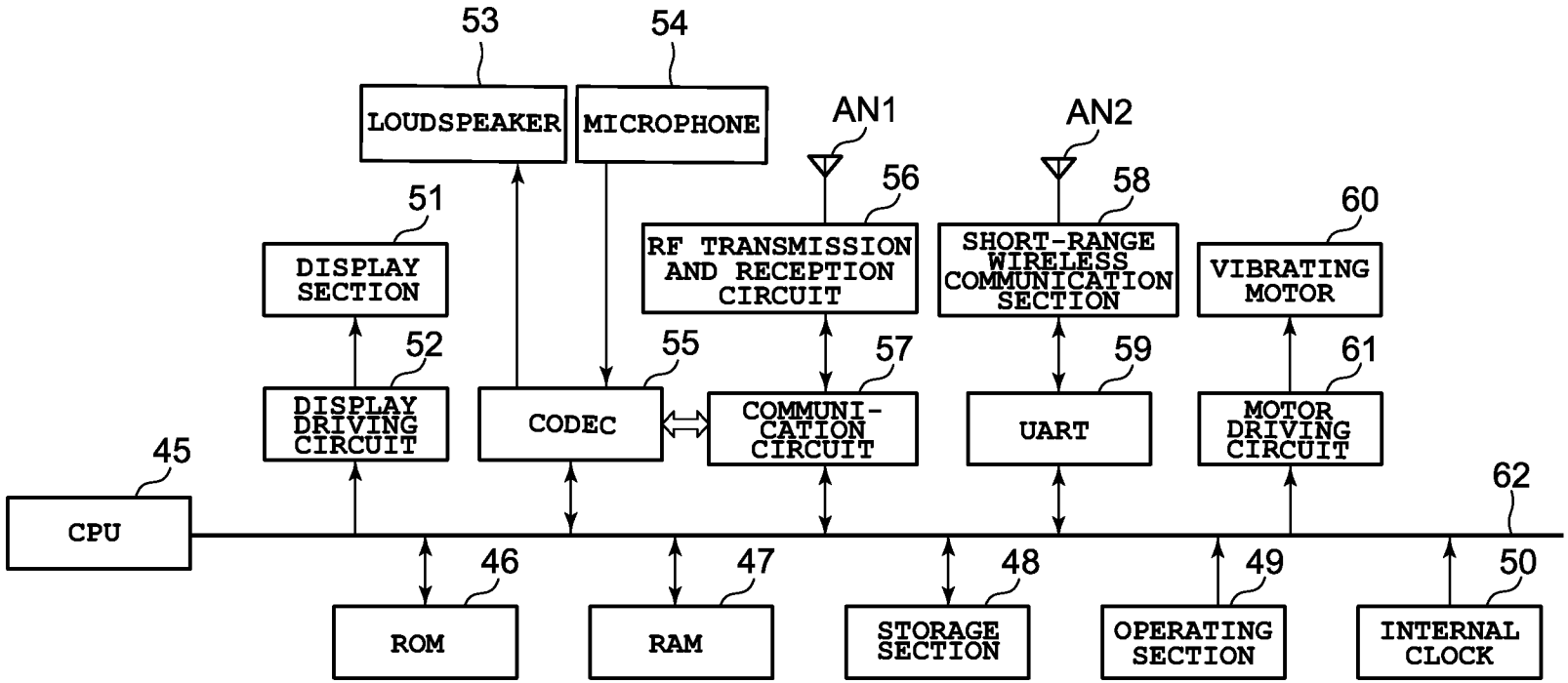
FIG. 10 is a block diagram of a circuit structure of a portable information terminal that communicates with the electronic watch depicted in FIG. 1.

The circuit structure of the portable information terminal 2 is described with reference to a block diagram depicted in FIG. 10.

The portable information terminal 2 includes, for example, a CPU 45, a ROM 46, a RAM 47, a storage section 48, an operating section 49, an internal clock 50, a display section 51, a display driving circuit 52, a loudspeaker 53, a microphone 54, a codec 55, an RF transmission and reception circuit 56, an antenna AN1 for RF transmission and reception, a communication circuit 57, a short-range wireless communication section 58, a UART 59, an antenna AN2 for short-range wireless communication, a vibrating motor 60, a motor driving circuit 61, and a bus 62 for connecting the CPU 45 and each of the other sections.

The CPU 45 performs the overall control of the entire operation of the portable information terminal 2 and various arithmetic processing. The ROM 46 stores various programs to be executed by the CPU 45 and initial setting data to be used by these programs. The RAM 47 provides a working memory space to the CPU 45. In the RAM 47, an execution program read from the ROM 46 is developed and temporary data is stored.

The storage section 48 is a non-volatile readable and writable memory and, for example, an EEPROM (Electrically Erasable and Programmable Read Only Memory) is used. In this storage section 48, for example, mail data transmitted and received by the portable information terminal 2 and various application programs and application data are stored.

The operating section 49 includes the plurality of operation keys 2*c*, making a conversion to an electrical signal based on a key operation by the user for output as an input signal to the CPU 45. The operating section 49 also includes an input detecting section using a touch operation on the touch panel of the input display section 2*b*. The internal clock 50 is a counter timing and retaining the current time. In the portable information terminal 2, the current time is read to be displayed on the display section 51. Current time data in the internal clock 50 is corrected as needed at the time of communication with a base station by the RF transmission and reception circuit 56 or at predetermined timing.

The display section 51 is a flat-type display panel such as a liquid-crystal display panel or an organic EL (Electro Luminescent) display panel. With a control signal sent from the CPU 45, the display driving circuit 52 is operated to cause the display section 51 as a display panel to make a display regarding various functions of the portable information terminal 2. The loudspeaker 53 converts an electrical signal to a voice signal based on a signal from the codec 55 for voice output. The microphone 54 makes a conversion to an electrical signal with an acoustic wave detected, and outputs the electrical signal to the codec 55.

The codec 55 decodes an inputted digital signal for voice output and sends the decoded signal as an analog signal to the loudspeaker 53, and encodes a voice signal obtained from the microphone 54 for output to the CPU 45 and the communication circuit 57. The RF transmission and reception circuit 56 performs transmission and reception processing regarding transmission with the base station using the antenna AN1 for RF transmission and reception. The communication circuit 57 performs various processing on transmission and reception data transmitted and received by the RF transmission and reception circuit 56 and exchanges data with the CPU 45 and the codec 55.

The short-range wireless communication section 58 is a communication control section for Bluetooth (registered trademark) communication with the electronic watch 1, which is an external device, via the short-range wireless antenna AN2. The short-range wireless communication section 58 supports communication in low power consumption mode of the Bluetooth Core Specification Version 4.0, and can transmit and receive data according to a time profile. Transmission data outputted from the CPU 45 is subjected to processing such as serial-parallel conversion at the UART 59 and is then transmitted from the short-range wireless communication section 58 to the electronic watch 1.

Reception data received by using the short-range wireless communication section 58 from the electronic watch 1 is subjected to processing such as parallel-serial conversion at the UART 59 and is then inputted to the CPU 45. The vibrating motor 60 causes vibration with a motor operation driven by the motor driving circuit 61, for example, when an incoming call or an incoming electronic mail is received at the portable information terminal 2.

Figure 11:
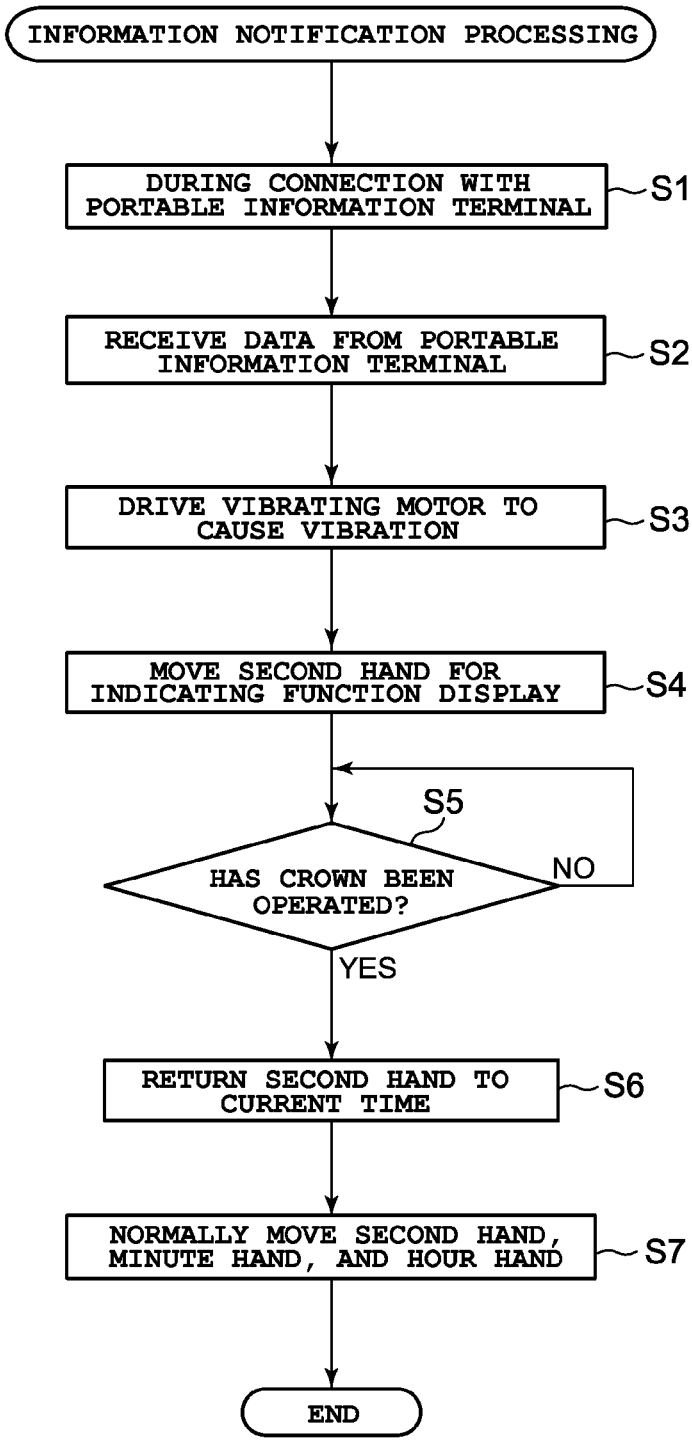
FIG. 11 is a diagram of an operation flow of information notification processing in the electronic watch depicted in FIG. 9.

Next, information notification processing in the electronic watch 1 is described with reference to an operation flow depicted in FIG. 11. In this case, FIG. 11 is a diagram of the procedure of the information notification processing to be executed by the CPU 30 of the electronic watch 1.

In the information notification processing, the electronic watch 1 performs Bluetooth (registered trademark) communication at Step S1 with the portable information terminal 2, which is an external device, via the antenna AN4 by using the short-range wireless communication section 36, and the procedure goes to Step S2 during communication.

At Step S2, when the electronic watch 1 receives transmission data when an incoming call, an incoming electronic mail, or the like comes to the portable information terminal 2 reception data received by the short-range wireless communication section 36 of the electronic watch 1 is subjected to serial-parallel conversion at the UART 37, the converted data is inputted to the CPU 30, and then the procedure goes to Step S3. At Step S3, the CPU 30 provides a control signal to the motor driving circuit 38 based on the reception data to cause the vibrating motor 20 of the information notifying device 11 to be driven.

With this, the eccentric rotation section 200 of the vibrating motor 20 eccentrically rotates to cause vibration, thereby notifying that transmission data from the portable information terminal 2 has been received. Here, the rotary plate 21 rotates with the eccentric rotation of the eccentric rotation section 20*c* of the vibrating motor 20, thereby opening the display opening 18 of the hour plate 16. With this, the first to third function displays 19*a* to 19*c* of the function display section 19 are each exposed through the display opening 18.

Here, with the rotation of the rotary plate 21, the link section 26 of the return member 24 pushes out the crown 7 toward the outside of the watch case 3. That is, when the rotary plate 21 rotates, the interlocked pin 25 of the return member 24 is moved and rotated accordingly, and the interlocked pin 25 pushes the one end 26*b* of the link section 26 to cause the link section 26 to rotate about the fulcrum 26*a*. With this, the other end 26*c* of the link section 26 pushes out the crown 7 toward the outside of the watch case 3.

As such, when the crown 7 is pushed out for switch operation to input an electrical signal to the CPU 30, the procedure goes to Step S4. At Step S4, the CPU 30 provides a control signal to the movement driving circuit 35 based on the reception data from the portable information terminal 2 to cause the first driving system of the clock movement 10 to be driven.

Here, only the second hand 13 is moved alone to indicate any one of the first to third function displays 19*a* to 19*c* of the function display section 19. For example, when the electronic watch 1 receives transmission data at the time of reception of an incoming call at the portable information terminal 2 at Step S3, the second hand 13 moves based on the reception data to indicate TEL of the first function display 19*a* of the function display section 19 at Step S4.

Similarly, when the electronic watch 1 receives transmission data at the time of reception of an incoming mail at the portable information terminal 2, the second hand 13 moves based on the reception data to indicate ML of the second function display 19*b* of the function display section 19. Furthermore, when the electronic watch 1 receives transmission data transmitted when the alarm time comes at the portable information terminal 2, the second hand 13 moves based on the reception data to indicate AL of the third function display 19*c* of the function display section 19.

As such, based on the reception data received from the portable information terminal 2 at Step S4, the second hand 13 of the electronic watch 1 moves to indicate any one of the first to third function displays 19*a* to 19*c* of the function display section 19. Then, the procedure goes to Step S5, where it is judged whether the crown 7 has been pushed in and operated to be switched. If the crown 7 has not been operated to be pushed in, the procedure waits until the crown 7 is pushed in and operated to be switched.

When the crown 7 is operated to be pushed in at Step S5, the rotary plate 21 is rotated by the return member 24 to close the display opening 18 of the hour plate 16. Also, with the crown 7 being operated to be pushed in, the crown 7 is operated to be switched to input an electrical signal to the CPU 30. With this, the procedure goes to Step S6, where the CPU 30 provides a control signal to the movement driving circuit 35 to drive the first driving system of the clock movement 10 to move only the second hand 13 alone for return to the current time.

Then, the procedure goes to Step S7, where the second hand 13, the minute hand 14, and the hour hand 15 are normally moved. That is, at Step S7, the CPU 30 provides a control signal to the movement driving circuit 35 to drive the first and second driving systems of the clock movement 10. With this, the second hand 13, the minute hand 14, and the hour hand 15 are normally moved, thereby ending the information notification processing.

As such, the information notifying device 11 of the electronic watch 1 includes the hour plate 16 with the display opening 18, the vibrating motor 20 placed on a lower side of the hour plate 16, the vibrating motor which causes vibration with eccentric rotation of the eccentric rotation section 20*c* for information notification, and the rotary plate 21 which rotates with the eccentric rotation of the eccentric rotation section 20*c* of the vibrating motor 20 and exposes the function display section 19 from the display opening 18 for information notification. Therefore, at the time of information notification by vibration of the vibrating motor 20, the user can be notified also visually of notification details by the rotary plate 21.

That is, in the information notifying device 11 of the electronic watch 1, when the eccentric rotation section 20*c* of the vibrating motor 20 eccentrically rotates to cause vibration, the rotary plate 21 can be rotated with the eccentric rotation of the eccentric rotation section 20*c* of the vibrating motor 20. Thus, the rotary plate 21 can be rotate without requiring a dedicated driving source to expose the function display section 19 from the display opening 18 of the hour plate 16 and visually notify the user of information.

With this, when the user is notified of information by vibration of the vibrating motor 20, the user can also be notified of notification details by the rotary plate 21 visually at the same time. In this case, the rotary plate 21 can be rotated without using a dedicated driving source. Thus, power consumption can be reduced, and the entire device can also be configured to be compact in size with a small mount space.

Also, in the information notifying device 11, the function display section 19 is configured to be provided on the upper surface of the housing 9 positioned on a lower side of the hour plate 16 so as to correspond to the display opening 18 of the hour plate 16 and be exposed through the display opening 18 when the rotary plate 21 rotates to open the display opening 18. Thus, with the rotary plate 21 being rotated by eccentric rotation of the eccentric rotation section 20 of the vibrating motor 20 to open the display opening 18 of the hour plate 16, the function display section 19 can be clearly viewed from above the hour plate 16 through the display opening 18.

Furthermore, the information notifying device 11 is configured so that the function display section 19 has the plurality of function displays 19*a* to 19*c* and, when the plurality of function displays 19*a* to 19*c* are exposed so as to correspond to the display opening 18 of the hour plate 16 according to the rotation of the rotary plate 21, any one of the exposed plurality of function displays 19*a* to 19*c* is selectively indicated by the second hand 13. Thus, the user can be accurately notified of notification details.

For example, when the electronic watch 1 receives data transmitted at the time of reception of an incoming call at the portable information terminal 2, TEL of the first function display 19*a* of the function display section 19 can be indicated by the second hand 13. When the electronic watch 1 receives data transmitted at the time of reception of an incoming mail at the portable information terminal 2, ML of the second function display 19*b* of the function display section 19 can be indicated by the second hand 13. Furthermore, when the electronic watch 1 receives data transmitted when the alarm time comes at the portable information terminal 2, AL of the third function display 19*c* of the function display section 19 can be indicated by the second hand 13.

Still further, the electronic watch 1 includes the short-range wireless communication section 36 communicating with the portable information terminal 2, which is an external device. With this, when the electronic watch 1 receives data transmitted from the portable information terminal 2, the user can be notified of such reception by the information notifying device 11. In this case, since the portable information terminal 2 includes the RF transmission and reception circuit 56, which is a long-range wireless communication section communicating with the base station, transmission data when the portable information terminal 2 receives an incoming call or an incoming mail from the base station can be transmitted to the electronic watch 1. Thus, the transmitted data can be received by the electronic watch 1 and the user can be notified of this reception by vibration of the vibrating motor 20 of the information notifying device 11, and also a function corresponding to the received data can be displayed by the function display section 19 of the information notifying device 11 for notification.

For example, when the portable information terminal 2 receives an incoming call or an incoming mail at a location such as inside a train where communication is prohibited and reception data is obtained, a function according to the reception data can be transmitted by the short-range wireless communication section 58 to the electronic watch 1. Furthermore, with this, the user can be notified by the information notifying device 11 of the electronic watch 1 of the function according to the reception data obtained by the portable information terminal 2. Thus, the portable information terminal 2 can receive an incoming call, an incoming mail, and others even at a location such as inside a train where communication is prohibited and can notify the user that reception data has been obtained.

(Second Embodiment)

Figure 12:
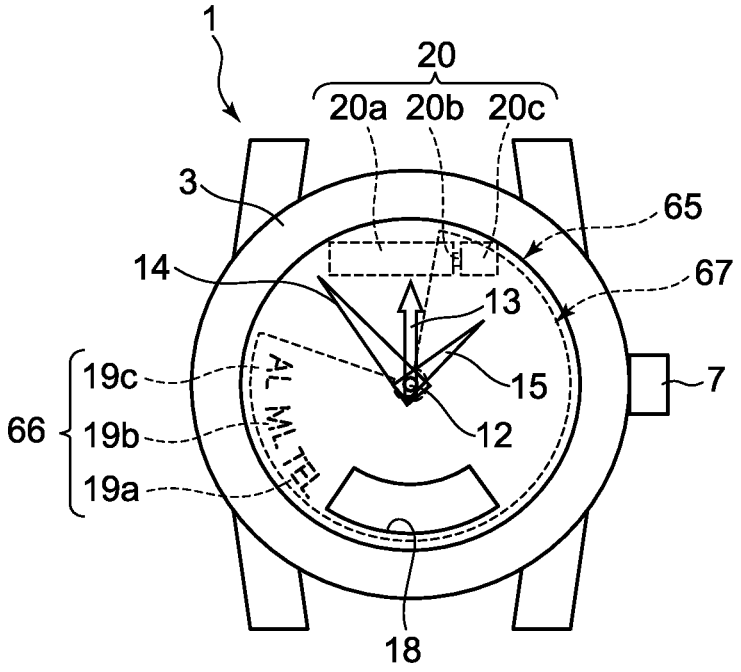
FIG. 12 is an enlarged front view of the state in which a display opening is closed with a rotary plate in a second embodiment to which the present invention is applied to an electronic watch.
Figure 13:
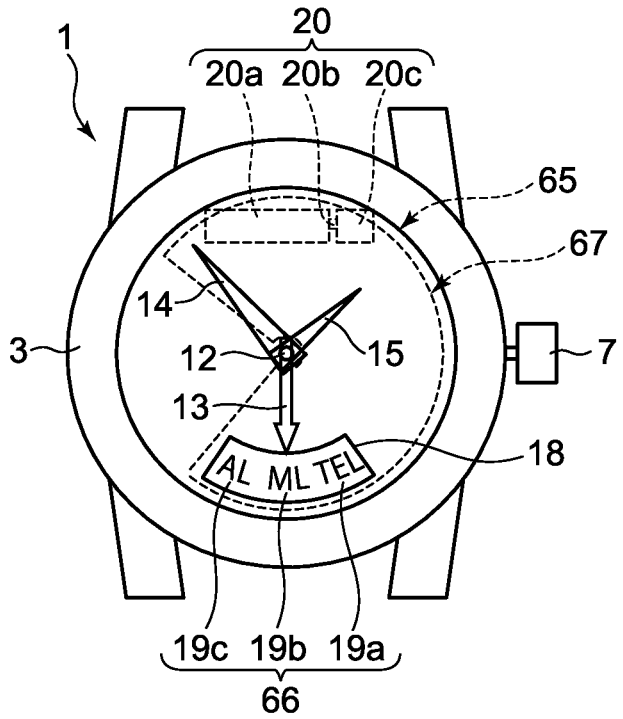
FIG. 13 is an enlarged front view of the state in which the rotary plate is rotated to cause a function display section to be exposed from the display opening in the electronic watch depicted in FIG. 12.

Next, with reference to FIG. 12 and FIG. 13, a second embodiment in which the present invention is applied to an electronic watch is described. Note that components identical to those of the first embodiment depicted in FIG. 1 to FIG. 11 are provided with the same reference numeral for description.

As depicted in FIG. 12 and FIG. 13, an information notifying device 65 of the electronic watch 1 is configured so that a function display section 66 is provided on a rotary plate 67. Other than that, the information notifying device 65 is approximately identical in configuration to that of the first embodiment.

In this case, as with the first embodiment, the rotary plate 67 is configured to rotate about the pointer shaft 12 at a predetermined angle, with eccentric rotation of the eccentric rotation section 20*c* of the vibrating motor 20. On an upper surface of the rotary plate 67, as depicted in FIG. 13, the function display section 66 is provided along a movement path with respect to the display opening 18 of the hour plate 16. As with the first embodiment, the function display section 66 has the first to third function displays 19*a* to 19*c*.

The function display section 66 is configured so that, in a normal state where the rotary plate 67 does not rotate as depicted in FIG. 12, the function display section 66 does not correspond to the display opening 18 of the hour plate 16 and keeps a state as being hidden below the hour plate 16 and, as depicted in FIG. 13, when the rotary plate 67 rotates in a counterclockwise direction with eccentric rotation of the eccentric rotation section 20*c* of the vibrating motor 20, the function display section 66 is exposed so as to correspond to the display opening 18 of the hour plate 16.

Also as depicted in FIG. 13, the function display section 66 is configured so that, when exposed so as to correspond to the display opening 18 of the hour plate 16, any one of the first to third function displays 19*a* to 19*c* is indicated by the second hand 13. That is, the second hand 13 is configured to indicate TEL of the first function display 19*a* of the function display section 66 when the electronic watch 1 receives data transmitted at the time of reception of an incoming call at the portable information terminal 2.

Similarly, the second hand 13 is configured to indicate ML of the second function display 19*b* of the function display section 66 when the electronic watch 1 receives data transmitted at the time of reception of an incoming mail at the portable information terminal 2 and indicate AL of the third function display 19*c* of the function display section 66 when the electronic watch 1 receives data transmitted when the alarm time comes at the portable information terminal 2.

According to the information notifying device 65 of the electronic watch 1, in addition to operations and effects similar to those of the first embodiment, the function display section 66 is provided on the upper surface of the rotary plate 67 along the movement path with respect to the display opening 18 of the hour plate 16, and is configured to be exposed through the display opening 18 when the rotary plate 67 rotates to cause the function display section 66 to correspond to the display opening 18. Thus, when the vibrating motor 20 vibrates for information notification, the function display section 66 of the rotary plate 67 can be clearly viewed from above the hour plate 16 through the display opening 18.

That is, according to the information notifying device 65, when the vibrating motor 20 vibrates for information notification, the rotary plate 67 rotates at a predetermined angle with eccentric rotation of the eccentric rotation section 20*c* of the vibrating motor 20, thereby allowing the function display section 66 to correspond to the display opening 18 of the hour plate 16. With this, the function display section 66 of the rotary plate 67 can be clearly viewed from above the hour plate 16 through the display opening 18.

(Third Embodiment)

Figure 14A:
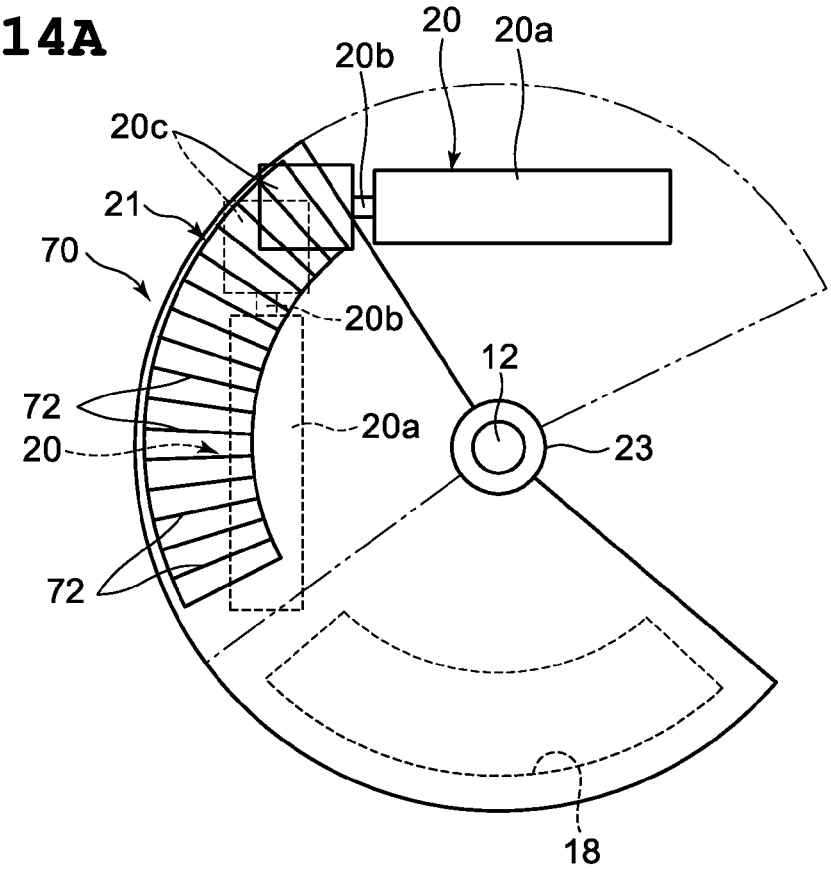
FIG. 14A is an enlarged view of a correspondence between a toothed section of an eccentric rotation section of a vibrating motor and engaging teeth of a rotary plate in a third embodiment to which the present invention is applied.
Figure 14B:
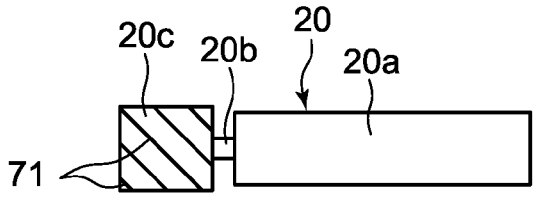
FIG. 14B is an enlarged view of the vibrating motor of the third embodiment.
Figure 14C:
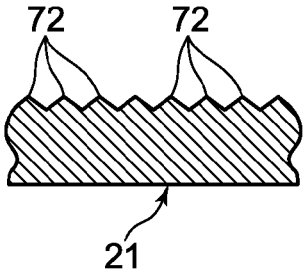
FIG. 14C is an enlarged sectional view of the engaging teeth of the rotary plate.

Next, with reference to FIG. 14A to FIG. 14C, a third embodiment in which the present invention is applied to an electronic watch is described. Also in this case, components identical to those of the first embodiment depicted in FIG. 1 to FIG. 11 are provided with the same reference numeral for description.

As depicted in FIG. 14A, an information notifying device 70 of the electronic watch 1 is configured to be provided with a toothed section 71 on an outer peripheral surface of the eccentric rotation section 20*c* of the vibrating motor 20 and also be provided with engaging teeth 72 on a lower surface of the rotary plate 21 along an arc shape. The toothed section 71 of the eccentric rotation section 20*c* engages with the engaging teeth 72. Other than that, the third embodiment is approximately similar in structure to the first embodiment.

In this case, the engaging teeth 72 of the rotary plate 21 are formed in a radial direction centering at the rotation center of the rotary plate 21 as depicted in FIG. 14A so as to have a saw-like sectional shape as depicted in FIG. 14C. As depicted in FIG. 14A and FIG. 14B, the toothed section 71 of the eccentric rotation section 20*c* of the vibrating motor 20 is formed in a helical shape. With this, the vibrating motor 20 is configured so that its placement position with respect to the rotary plate 21 can be changed by placing the toothed section 71 of the eccentric rotation section 20*c* at a position of engaging with the engaging teeth 72 of the rotary plate 21.

According to the information notifying device 70 of the electronic watch 1, the helical-shaped toothed section 71 is provided on the outer peripheral surface of the eccentric rotation section 20*c* of the vibrating motor 20, and the engaging teeth 72 are provided on the lower surface of the rotary plate 21, which is a contact face with which the eccentric rotation section 20*c* repeatedly makes contact and non-contact. Thus, when the eccentric rotation section 20*c* of the vibrating motor 20 eccentrically rotates, with engagement of the toothed section 71 of the eccentric rotation section 20*c* and the engaging teeth 72 of the rotary plate 21, the rotary plate 21 can be reliably rotated in a good condition.

In this case, the engaging teeth 72 of the rotary plate 21 are formed in a radial direction centering at the rotation center of the rotary plate 21 so as to have a saw-like sectional shape, and the toothed section 71 of the eccentric rotation section 20*c* of the vibrating motor 20 is formed in a helical shape. Thus, with the toothed section 71 of the eccentric rotation section 20*c* and the engaging teeth 72 of the rotary plate 21 being engaged together according to the helix angle of the toothed section 71 of the eccentric rotation section 20*c*, the placement position of the vibrating motor 20 with respect to the rotary plate 21 can be changed. For this reason, the vibrating motor 20 can be freely placed at any position, such as a position indicated by solid lines in FIG. 14A or a position indicated by dotted lines in FIG. 14A.

Figure 15A:
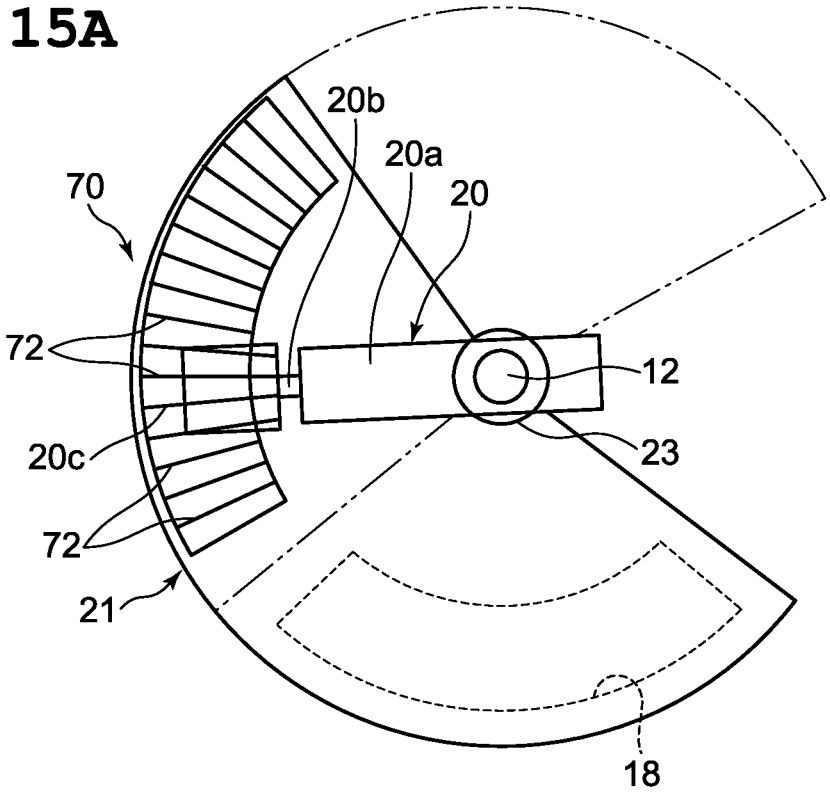
FIG. 15A is an enlarged view of a correspondence between a toothed section of an eccentric rotation section of a vibrating motor and engaging teeth of a rotary plate in a modification example of the third embodiment of the electronic watch depicted in FIG. 14A, FIG. 14B, and FIG. 14C.
Figure 15B:
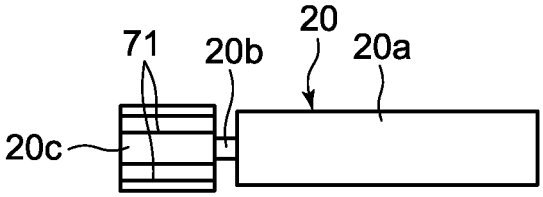
FIG. 15B is an enlarged view of the vibrating motor of the modification example.

It has been described in the above third embodiment that the toothed section 71 of the eccentric rotation section 20*c* is formed in a helical shape. However, this is not meant to be restrictive. For example, as in a modification example depicted in FIG. 15A and FIG. 15B, the toothed section 71 of the eccentric rotation section 20*c* of the vibrating motor 20 is not required to be formed in a helical shape, and may be formed in a shape approximately identical to a toothed section of a general gear wheel. In this case, it is sufficient that the vibrating motor 20 is placed at a position passing through the rotation center of the rotary plate 21.

It has also been described in the above first to third embodiments that the present invention is configured so that any one of the first to third function displays 19*a* to 19*c* of the function display section 19, 66 is indicated by the second hand 13. However, an indication is not necessarily required to be made by the second hand 13, and may be made by the minute hand 14 or the hour hand 15 by moving each of the minute hand 14 and the hour hand 15 alone. Alternatively, a function hand may be provided separately from the second hand 13, the minute hand 14, and the hour hand 15 for indication.

Furthermore, it has been described in the above first to third embodiments that the present invention is configured so that the rotary plate 21, 67 rotated by the vibrating motor 20 is returned to the initial position by the return member 24. However, the rotary plate 21, 67 is not necessarily required to be returned to the initial position by the return member 24. For example, by rotating the vibrating motor 20 in reverse, the rotary plate 21, 67 may be rotated in reverse to be returned to the initial position.

Still further, it has been described in the above first to third embodiments that the present invention is configured to include the short-range wireless communication section 36 performing wireless communication with the portable information terminal 2, which is an external device. However, wireless communication is not necessarily required to be performed with the portable information terminal 2. The present invention may be configured to perform optical communication by light such as infrared rays.

Yet still further, it has been described in the above first to third embodiments that the present invention is configured so that the first to third function displays 19*a* to 19*c* of the function display section 19, 66 display a call, a mail, and alarm time, respectively, transmitted from the portable information terminal 2. However, it is not necessarily required to display the function transmitted from the portable information terminal 2. For example, the present invention may be configured so that a plurality of functions included in the electronic watch 1 itself may be displayed.

Yet still further, it has been described in the above first to third embodiments and modification example that the present invention is applied to the electronic watch 1. However, the present invention is not necessarily required to be the electronic watch 1. For example, the present invention can be applied to various pointer-type electronic timepieces such as a travel watch, an alarm clock, a table clock, and a wall clock. Also, the present invention can also be widely applied not only to electronic timepieces but also to electronic devices such as a portable information device.

While the present invention has been described with reference to the preferred embodiments, it is intended that the invention be not limited by any of the details of the description therein but includes all the embodiments which fall within the scope of the appended claims.

What is claimed is:

1. An information notifying device comprising:

an hour plate with a display opening;

a vibrating motor which is placed on a lower side of the hour plate and causes vibration with eccentric rotation of an eccentric rotation section for information notification; and a rotary plate which rotates with the eccentric rotation of the eccentric rotation section of the vibrating motor and exposes a function display section from the display opening for information notification.

2. The information notifying device according to claim 1, wherein the function display section is provided so as to correspond to the lower side of the display opening of the hour plate, and exposed through the display opening when the rotary plate rotates to open the display opening.

3. The information notifying device according to claim 2, wherein the function display section has a plurality of function displays and, when the plurality of function displays correspond to the display opening of the hour plate and are exposed in accordance with the rotation of the rotary plate, any one of the plurality of exposed function displays is selectively indicated by a pointer.

4. The information notifying device according to claim 3, wherein the eccentric rotation section of the vibrating motor has a toothed section provided on outer peripheral surface thereof, and engaging teeth with which the toothed section engages are provided on a contact face of the rotary plate with which the eccentric rotation section repeatedly makes contact and non-contact.

5. The information notifying device according to claim 2, wherein the eccentric rotation section of the vibrating motor has a toothed section provided on outer peripheral surface thereof, and engaging teeth with which the toothed section engages are provided on a contact face of the rotary plate with which the eccentric rotation section repeatedly makes contact and non-contact.

6. The information notifying device according to claim 2, further comprising:

a communication section which communicates with an external device.

7. An electronic timepiece comprising the information notifying device according to claim 2.

8. The information notifying device according to claim 1, wherein the function display section is provided on an upper surface of the rotary plate along a movement path with respect to the display opening of the hour plate, and exposed through the display opening when the rotary plate rotates to open the display opening.

9. The information notifying device according to claim 8, wherein the function display section has a plurality of function displays and, when the plurality of function displays correspond to the display opening of the hour plate and are exposed in accordance with the rotation of the rotary plate, any one of the plurality of exposed function displays is selectively indicated by a pointer.

10. The information notifying device according to claim 9, wherein the eccentric rotation section of the vibrating motor has a toothed section provided on outer peripheral surface thereof, and engaging teeth with which the toothed section engages are provided on a contact face of the rotary plate with which the eccentric rotation section repeatedly makes contact and non-contact.

11. The information notifying device according to claim 8, wherein the eccentric rotation section of the vibrating motor has a toothed section provided on outer peripheral surface thereof, and engaging teeth with which the toothed section engages are provided on a contact face of the rotary plate with which the eccentric rotation section repeatedly makes contact and non-contact.

12. The information notifying device according to claim 8, further comprising:

a communication section which communicates with an external device.

13. An electronic timepiece comprising the information notifying device according to claim 8.

14. The information notifying device according to claim 1, wherein the function display section has a plurality of function displays and, when the plurality of function displays correspond to the display opening of the hour plate and are exposed in accordance with the rotation of the rotary plate, any one of the plurality of exposed function displays is selectively indicated by a pointer.

15. The information notifying device according to claim 14, wherein the eccentric rotation section of the vibrating motor has a toothed section provided on outer peripheral surface thereof, and engaging teeth with which the toothed section engages are provided on a contact face of the rotary plate with which the eccentric rotation section repeatedly makes contact and non-contact.

16. The information notifying device according to claim 14, further comprising:

a communication section which communicates with an external device.

17. The information notifying device according to claim 1, wherein the eccentric rotation section of the vibrating motor has a toothed section provided on outer peripheral surface thereof, and engaging teeth with which the toothed section engages are provided on a contact face of the rotary plate with which the eccentric rotation section repeatedly makes contact and non-contact.

18. The information notifying device according to claim 17, further comprising:

a communication section which communicates with an external device.

19. The information notifying device according to claim 1, further comprising:

a communication section which communicates with an external device.

20. An electronic timepiece comprising the information notifying device according to claim 1.

* * * * *